US008381329B2

(12) United States Patent
Bayley et al.

(10) Patent No.: US 8,381,329 B2
(45) Date of Patent: Feb. 26, 2013

(54) CAPACITIVE SENSING FOR WASHROOM FIXTURE

(75) Inventors: Graeme S. Bayley, Brookfield, WI (US); Kenneth A. Kreitzer, Germantown, WI (US); Nathaniel J. Kogler, Milwaukee, WI (US); Steven R. Reckamp, Sun Prairie, WI (US); Nick B. Guzzardo, Edgerton, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 1279 days.

(21) Appl. No.: 11/877,469

(22) Filed: Oct. 23, 2007

(65) Prior Publication Data

US 2008/0109956 A1 May 15, 2008

Related U.S. Application Data

(60) Provisional application No. 60/853,822, filed on Oct. 24, 2006, provisional application No. 60/927,084, filed on May 1, 2007.

(51) Int. Cl.
*E03C 1/05* (2006.01)

(52) U.S. Cl. ..... 4/623

(58) Field of Classification Search ..... 4/623, DIG. 3, 4/313, 302, 304, 305; 324/663, 358, 444, 324/448, 347, 367, 519, 686, 671; 251/129.03, 251/129.04, 129.06; 137/801; 335/229
See application file for complete search history.

(56) References Cited

U.S. PATENT DOCUMENTS

| | | | | |
|---|---|---|---|---|
| 3,347,520 | A | 10/1967 | Owczarek | |
| 3,551,919 | A | 1/1971 | Forbes | |
| 3,585,653 | A * | 6/1971 | Griffin et al. | 4/623 |
| 3,751,736 | A | 8/1973 | Egli | |
| 3,944,792 | A | 3/1976 | Sautner | |
| 3,974,825 | A | 8/1976 | Normann | |
| 4,021,679 | A | 5/1977 | Bolle et al. | |
| 4,032,822 | A | 6/1977 | Un | |
| 4,032,855 | A | 6/1977 | Holman, II | |
| 4,253,073 | A | 2/1981 | Stegens | |
| 4,270,473 | A | 6/1981 | Brienza | |

(Continued)

FOREIGN PATENT DOCUMENTS

| | | |
|---|---|---|
| DE | 3400575 | 7/1985 |
| DE | 10109152 | 9/2002 |

(Continued)

OTHER PUBLICATIONS

IPO Examination Report regarding related UK Application No. GB0906660.6 (originally published as WO 2008/051973), dated Mar. 10, 2011 (2 pages).

(Continued)

*Primary Examiner* — Len Tran
*Assistant Examiner* — Chee-Chong Lee
(74) *Attorney, Agent, or Firm* — Foley & Lardner LLP

(57) ABSTRACT

A capacitive sensing system and method for a hand washing lavatory system is disclosed. The lavatory system comprises a receptacle defining a hand washing area, a fixture configured to deliver water to the receptacle, and a capacitive sensing system configured to detect the presence of a user and actuate the fixture. The capacitive sensing system comprises a first sense electrode coupled to the receptacle and configured to measure a first capacitive value, a second sense electrode coupled to the receptacle spaced apart from the first sense electrode and configured to measure a second capacitive value, and a circuit configured to control operation of the fixture in response to a change in the first capacitive value relative to the second capacitive value.

18 Claims, 10 Drawing Sheets

U.S. PATENT DOCUMENTS

RE31,070 E 11/1982 Meyer et al.
4,410,993 A 10/1983 Zschauer
4,442,921 A 4/1984 Sherman
4,449,122 A 5/1984 Whitmer
4,547,768 A 10/1985 Kulhavy
4,722,372 A 2/1988 Hoffman et al.
4,733,419 A 3/1988 Nee
4,760,613 A * 8/1988 Bobak ..... 4/243.2
4,762,273 A 8/1988 Gregory et al.
4,788,998 A 12/1988 Pepper et al.
4,830,791 A 5/1989 Muderlak et al.
4,839,735 A 6/1989 Kyomasu et al.
4,841,583 A 6/1989 Ohara et al.
4,857,856 A 8/1989 Coleman et al.
4,872,485 A 10/1989 Laverty, Jr.
4,879,461 A 11/1989 Philipp
4,886,207 A 12/1989 Lee et al.
4,921,131 A 5/1990 Binderbauer et al.
4,931,962 A 6/1990 Palleiko
4,938,384 A 7/1990 Pilolla et al.
4,967,935 A 11/1990 Celest
4,972,070 A 11/1990 Laverty, Jr.
4,985,944 A 1/1991 Shaw
4,995,585 A 2/1991 Gruber et al.
5,010,460 A 4/1991 Lin
5,038,972 A 8/1991 Muderlak et al.
5,054,555 A 10/1991 Lalande et al.
5,065,139 A 11/1991 Shefsky
D323,884 S 2/1992 Muderlak
5,086,526 A 2/1992 Van Marcke
5,095,470 A 3/1992 Oka et al.
D325,253 S 4/1992 Muderlak
5,111,477 A 5/1992 Muderlak
D330,758 S 11/1992 Muderlak
5,168,483 A 12/1992 Oka et al.
5,175,505 A * 12/1992 Magenau et al. ..... 324/671
5,175,791 A 12/1992 Muderlak et al.
5,199,118 A 4/1993 Cole et al.
5,217,035 A 6/1993 Van Marcke
D338,522 S 8/1993 Muderlak
5,244,179 A 9/1993 Wilson
5,249,718 A 10/1993 Muderlak
5,298,887 A 3/1994 Pepping
5,305,779 A 4/1994 Izaguirre
5,322,086 A 6/1994 Sullivan
5,365,787 A 11/1994 Hernandez et al.
5,369,818 A * 12/1994 Barnum et al. ..... 4/624
RE34,847 E 2/1995 Muderlak et al.
5,394,969 A 3/1995 Harbaugh
5,397,028 A 3/1995 Jesadanont
D357,977 S 5/1995 Muderlak
5,427,350 A 6/1995 Rinkewich
5,449,117 A 9/1995 Muderlak et al.
D363,981 S 11/1995 Muderlak
D366,520 S 1/1996 Muderlak
5,487,305 A 1/1996 Ristic et al.
5,492,247 A 2/1996 Shu et al.
5,507,870 A 4/1996 Siebert
D370,057 S 5/1996 Muderlak
5,549,273 A 8/1996 Aharon
5,566,702 A 10/1996 Philipp
5,617,105 A 4/1997 Tsunekawa et al.
5,625,908 A 5/1997 Shaw
5,632,414 A 5/1997 Merriweather, Jr.
5,651,044 A 7/1997 Klotz, Jr. et al.
5,680,879 A 10/1997 Sheih et al.
5,730,165 A 3/1998 Philipp
5,730,643 A 3/1998 Bartlett et al.
5,771,501 A 6/1998 Shaw
5,781,942 A 7/1998 Allen et al.
5,823,390 A 10/1998 Muderlak et al.
5,871,389 A 2/1999 Bartlett et al.
5,884,808 A 3/1999 Muderlak et al.
5,908,140 A 6/1999 Muderlak et al.
5,933,288 A 8/1999 Plesko
5,940,899 A 8/1999 Mankin et al.
5,952,835 A 9/1999 Coveley
6,052,841 A 4/2000 Mankin et al.
6,080,039 A 6/2000 Bartlett et al.
6,168,080 B1 1/2001 Verschuur et al.
6,202,980 B1 3/2001 Vincent et al.
6,227,940 B1 5/2001 Bartlett et al.
6,231,428 B1 5/2001 Maloney et al.
6,239,590 B1 5/2001 Krivy et al.
6,283,504 B1 9/2001 Stanley et al.
6,285,050 B1 9/2001 Emma et al.
6,309,290 B1 10/2001 Wang et al.
6,363,549 B2 4/2002 Humpert et al.
6,367,092 B2 4/2002 Cardwell et al.
6,373,235 B1 4/2002 Barker
6,383,057 B1 5/2002 Bartlett et al.
6,394,310 B1 5/2002 Muderlak et al.
6,412,655 B1 7/2002 Stuetzel et al.
6,419,844 B1 7/2002 Krivy et al.
6,420,892 B1 7/2002 Krivy et al.
6,431,000 B1 8/2002 Ostendorf et al.
6,467,651 B1 10/2002 Muderlak et al.
6,513,787 B1 2/2003 Jeromson et al.
6,520,535 B1 2/2003 Stanley et al.
6,526,839 B1 3/2003 Barger et al.
6,592,067 B2 7/2003 Denen et al.
6,644,689 B2 11/2003 Murphy
6,651,851 B2 11/2003 Muderlak et al.
6,684,443 B2 2/2004 Thomas et al.
6,731,209 B2 5/2004 Wadlow et al.
6,769,580 B2 8/2004 Muderlak et al.
6,778,086 B2 8/2004 Morrone et al.
6,793,170 B2 9/2004 Denen et al.
6,838,887 B2 1/2005 Denen et al.
6,871,815 B2 3/2005 Moody et al.
6,929,150 B2 8/2005 Muderlak et al.
6,938,280 B2 9/2005 Wawrla et al.
6,962,168 B2 * 11/2005 McDaniel et al. ..... 137/624.12
6,995,670 B2 2/2006 Wadlow et al.
7,017,856 B2 3/2006 Moody et al.
7,075,768 B2 7/2006 Kaneko
7,230,435 B2 * 6/2007 Kunikiyo et al. ..... 324/658
2001/0034899 A1 11/2001 Cardwell et al.
2002/0040786 A1 4/2002 Davey et al.
2002/0109036 A1 8/2002 Denen et al.
2002/0175814 A1 11/2002 Wadlow et al.
2003/0116736 A1 6/2003 Muderlak
2004/0041110 A1 3/2004 Kaneko
2004/0050876 A1 3/2004 Muderlak et al.
2004/0068784 A1 4/2004 Muderlak
2004/0085206 A1 5/2004 Wadlow et al.
2004/0090245 A1 5/2004 Kitahara
2004/0143898 A1 7/2004 Jost et al.
2004/0160234 A1 8/2004 Denen et al.
2004/0164260 A1 8/2004 Jost
2004/0194196 A1 10/2004 Muderlak
2004/0262554 A1 12/2004 Muderlak et al.
2005/0000015 A1 * 1/2005 Kaneko ..... 4/623
2005/0072874 A1 4/2005 Denen et al.
2005/0127232 A1 6/2005 Moody et al.
2005/0150557 A1 7/2005 McDaniel et al.
2005/0199843 A1 9/2005 Jost et al.
2005/0205612 A1 9/2005 Muderlak et al.
2005/0218161 A1 10/2005 Muderlak et al.
2005/0247735 A1 11/2005 Muderlak et al.
2006/0054733 A1 3/2006 Moody et al.
2006/0130225 A1 6/2006 Muderlak et al.

FOREIGN PATENT DOCUMENTS

EP 1058000 2/1967
EP 1170775 11/1969
EP 1181630 2/1970
EP 1204770 9/1970
EP 1212771 11/1970
EP 1509600 5/1978
EP 0581605 2/1994
EP 0675234 10/1995
EP 0924354 6/1999
EP 1230886 8/2002
EP 1232715 8/2002
EP 0994667 4/2003
EP 01586713 10/2005

| | | |
|---|---|---|
| GB | 1058000 | 2/1967 |
| GB | 1170775 | 11/1969 |
| GB | 1181630 | 2/1970 |
| GB | 1204770 | 9/1970 |
| GB | 1212771 | 11/1970 |
| GB | 1213356 | 11/1970 |
| GB | 1509600 | 5/1978 |
| GB | 2065190 | 6/1981 |
| GB | 2345138 | 6/2000 |
| JP | 58173330 | 10/1983 |
| JP | 60142131 | 7/1985 |
| JP | 60184781 | 9/1985 |
| JP | 1149268 | 6/1989 |
| JP | 1207498 | 8/1989 |
| JP | 1262647 | 10/1989 |
| JP | 2177168 | 7/1990 |
| JP | 2201691 | 8/1990 |
| JP | 2302975 | 12/1990 |
| JP | 3105818 | 5/1991 |
| JP | 3213747 | 9/1991 |
| JP | 3293411 | 12/1991 |
| JP | 4093428 | 3/1992 |
| JP | 4251018 | 3/1992 |
| JP | 4093429 | 9/1992 |
| JP | 4251387 | 9/1992 |
| JP | 5076370 | 3/1993 |
| JP | 5168987 | 7/1993 |
| JP | 5293059 | 11/1993 |
| JP | 6306912 | 11/1994 |
| JP | 7189313 | 7/1995 |
| JP | 8177105 | 7/1996 |
| JP | 8228963 | 9/1996 |
| JP | 10071105 | 3/1998 |
| JP | 10262870 | 10/1998 |
| JP | 10314073 | 12/1998 |
| WO | WO 95/27103 | 10/1995 |
| WO | WO 97/23738 | 7/1997 |
| WO | WO 99/57381 | 11/1999 |
| WO | WO 99/58040 | 11/1999 |
| WO | WO 02/40786 | 5/2002 |
| WO | WO 02/063582 | 8/2002 |
| WO | WO 2004/065829 | 8/2004 |
| WO | WO 2004/090245 | 10/2004 |
| WO | WO 2008/051973 | 5/2008 |

OTHER PUBLICATIONS

Converter IC for Capacitive Signals CAV424, Analog Microelectronics, Jan. 2002, 7 pages.

* cited by examiner

CAPACITIVE SENSING FOR WASHROOM FIXTURE

CROSS-REFERENCE TO RELATED APPLICATIONS

This application claims priority to (i) provisional patent Application No. 60/853,822 entitled "CAPACITIVE SENSING FOR WASHROOM FIXTURE" and filed on Oct. 24, 2006, the full disclosure of which is hereby incorporated herein by reference; and (ii) provisional patent Application No. 60/927,084 entitled "CAPACITIVE SENSING FOR WASHROOM FIXTURE" and filed on May 1, 2007, the full disclosure of which is hereby incorporated herein by reference.

BACKGROUND

The present inventions relate generally to washroom fixtures. The present inventions also relate to a washroom fixture such as a lavatory system having a control system suitable for providing "hands-free" operation of one or more fixtures (e.g., sprayheads, faucets, showerheads, soap or lotion dispensers, hand dryers, flushers for toilets and/or urinals, emergency fixtures, etc.) within the lavatory system. More particularly, the present inventions relate to a lavatory system having a control system utilizing a capacitive sensing system to detect the presence of an object (e.g., the hand of a user, etc.) and actuate the one or more fixtures. The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the embodiments which follow.

It is generally known to provide a lavatory system having at least one fixture that conventionally requires manual manipulation by a user in order to operate. It is further known to provide an electrical and/or electronic control system for providing "hands-free" operation of the fixture. Not requiring a user to physically contact or touch the fixture for its operation may be desirable for various sanitary and/or accessibility considerations.

It is also generally known to provide an electrical and/or electronic control system utilizing an infrared (IR) sensor to detect the presence of an object and actuate one or more fixtures of the lavatory system. Such control systems generally have a transmitter that is configured to emit pulses of infrared light into a sensing region (e.g., an area adjacent to the fixture, etc.) and a receiver that is configured to measure the level of infrared light in the sensing region. Ideally, when an object enters the sensing region, at least a portion of the infrared light emitted from the transmitter will be reflected by the object and detected by the receiver which in turn creates a signal representative of the level of infrared light in the sensing region that can be used to determine whether the fixture should be actuated.

In the case of control systems utilizing an IR sensor, false activations of a fixture and/or a failure to detect an object may arise due to variations in the reflectivity of objects near the fixture and/or damage (e.g., contamination, etc.) of the optics of the IR sensor. False activations may ultimately result in a waste of resources (e.g., water, soap, towels, energy, etc.) that is contrary to the benefits of having a "hands free" operated fixture. Likewise, missed detections may frustrate a user attempting to realize the benefits of the fixture.

An alternative to an IR sensor, is a capacitive sensing system. Capacitive sensing systems generally provide an electric field and rely on a change in the electric field for sensing purposes. While capacitive sensing systems may be advantageous to IR sensors since capacitive sensing systems are not susceptible to false and/or missed detections due to reflectivity variations and/or optic damage, the use of capacitive sensing systems create additional issues. For example, variations in the environment may cause interfering variations in capacitance which may lead to false and/or missed detections. Such variations may be caused by contaminants on the surface of the electrodes or other objects in the electric field, changes in ambient humidity, gradual variations in the proximity or composition of nearby objects, or variations in the sensor mounting locations. All of such variations are likely occurrences in the environment of a lavatory system.

It would be advantageous to provide a lavatory system for use in commercial, educational, or residential applications, having one or more fixtures and a control system for enabling "hands-free" operation of the fixtures wherein the control system utilizes a capacitive sensing system. It would also be advantageous to provide a control system utilizing a capacitive sensing system that is capable of improved sensitivity and reliability, particularly in the typical environment of a lavatory system. It would further be advantageous to provide a control system utilizing a capacitive sensing system that reduces or minimizes the number of missed detections by providing an improved electrode plate configuration. It would further be advantageous to provide a power management system providing for the efficient use of the electrical energy required to operate a control system utilizing a capacitive sensing system, such as electrical energy generated by one or more photovoltaic cells. It would further be advantageous to provide a capacitive sensing system that detects an object within a sensing region regardless of the direction in which the object enters the sensing region, allows for use of a large plate size to maximize the detection signal, does not require the use of a guard plate, is able to extend detection window farther from an output of the fixture, and/or offers less difference between wet and dry conditions.

Accordingly, it would be desirable to provide for a lavatory system and/or capacitive sensing system having one or more of these or other advantageous features. To provide an inexpensive, reliable, and widely adaptable capacitive sensing system for a lavatory system that avoids the above-referenced and other problems would represent a significant advance in the art.

SUMMARY

One embodiment of the present invention relates to a hand-washing lavatory system comprising a receptacle defining a hand washing area; a fixture configured to deliver water to the hand washing area; a first sense electrode coupled to the receptacle and configured to measure a first capacitive value; a second sense electrode coupled to the receptacle spaced apart from the first sense electrode and configured to measure a second capacitive value; and a circuit configured to control operation of the fixture in response to a change in the first capacitive value relative to the second capacitive value.

Another embodiment of the present invention relates to a hand-washing lavatory station comprising a deck having one or more receptacles providing one or more hand washing stations, and a sink line defining the top of the one or more receptacles. The hand-washing lavatory station also comprises at least one fixture located at least partially above the sink line and configured to deliver water to one or more of the hand washing areas. The hand-washing lavatory station also comprises a first sense electrode integrated with the deck and located below the sink line, and configured to measure a first capacitive value in the one or more hand washing area. The hand-washing lavatory station also comprises a second sense electrode integrated with the deck and located adjacent to the first electrode and below the sink line and configured to measure a second capacitive value in the one or more hand washing area. The hand-washing lavatory station also comprises a valve movable between an open position wherein water is permitted to flow through the fixture and a closed position wherein water is prevented from flowing through the fixture. The hand-washing lavatory station also comprises a circuit coupled to the first electrode, the second electrode, and the valve, and configured to move the valve between the open position and the closed position in response to a change in the first capacitive value relative to the second capacitive value.

Another embodiment of the present invention relates to a method of operating the hand washing lavatory station. The hand washing lavatory station may comprise a deck, a first sense electrode, and a second sense electrode, the deck includes one or more hand-washing receptacles and a sink line defining the top of the one or more receptacles, the first sense electrode is integrated with the deck and located below the sink line and is configured to measure a first capacitive value in the one or more hand washing area, the second sense electrode is integrated with the deck and located adjacent to the first electrode and below the sink line and is configured to measure a second capacitive value in the one or more hand washing area. The method comprises operating within a non-activated loop wherein the fixture is waiting to be used; detecting a first capacitive value with a first sense electrode and a second capacitive value with a second sense electrode; calculating a difference between the first capacitive value and the second capacitive value over a predetermined time period; returning to the non-activated loop if an activation event has not occurred; operating within an activated loop and activating a fixture for a hand washing operation if an activation event has occurred; detecting a third capacitive value with the first sense electrode and a fourth capacitive value with the second sense electrode; calculating a difference between the third capacitive value and the fourth capacitive value over a predetermined time period; resetting the run time if a reactivation activation event has occurred the system; decrementing the run time if the reactivation event has not occurred; and deactivating the fixture after expiration of the run time and returning to the delay period to check for further activation of the system.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF THE PREFERRED AND EXEMPLARY EMBODIMENTS

Figure 1:
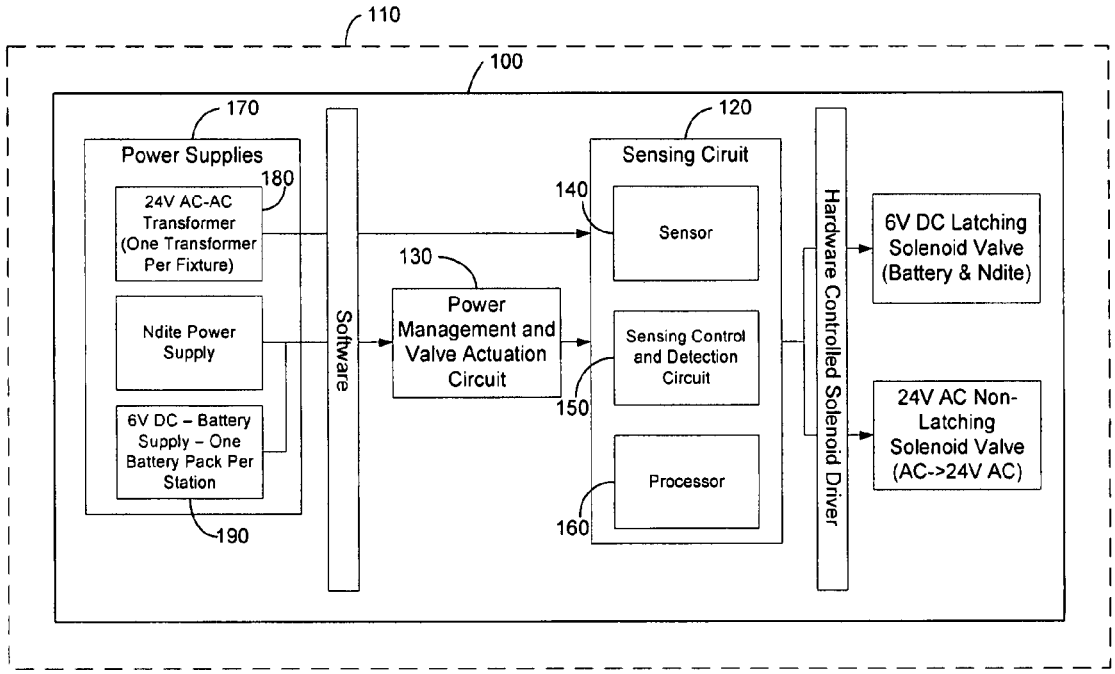
FIG. 1 is a block diagram illustrating a capacitive sensing system for use in a hand-washing lavatory system according to an exemplary embodiment.

FIG. 1 shows a capacitive sensing system 100 for use in a hand-washing lavatory system 110 with any of a variety of washroom fixtures (e.g., sprayheads, faucets, showerheads, soap or lotion dispensers, hand dryers, flushers for toilets and/or urinals, emergency fixtures, towel dispenser, wash fountains, etc.). Capacitive system 100 includes a sensing circuit 120 and a power management and valve actuation circuit 130 are typically controlled by software. Capacitive system 100 includes a sensor 140, a sensing control and detection circuit 150, and a processor 160 (e.g., a CPU, standard control logic, field programmable gate array (FPGA), etc.). Sensing circuit 120 is coupled to a pair of solenoid valves (e.g., a DC latching solenoid valve, an AC non-latching solenoid valve, etc.) that are typically driven and/or controlled by a hardware controlled solenoid driver.

The system is configured to detect the presence of a user seeking to activate the fixture. In the illustrated embodiments of FIGS. 2-7 and 12, the fixture is shown as a sprayhead on a lavatory system or wash fountain. According to other exemplary embodiments, the fixture may be a faucet, shower, showerhead, soap or lotion dispenser, hand dryer, flushers for toilets and/or urinals, emergency fixture, towel dispenser, drinking fountain, or the like. The system operates based on a user's internal dielectric—by detecting a sensed capacitance and evaluating it over time. The faucet/sprayhead may be any of a variety of commercially available products configured to be electronically actuated by an input signal. According to an alternative embodiment, the system operates based on a user's internal ground—by detecting a sensed capacitance and comparing to a comparison value.

Figure 2:
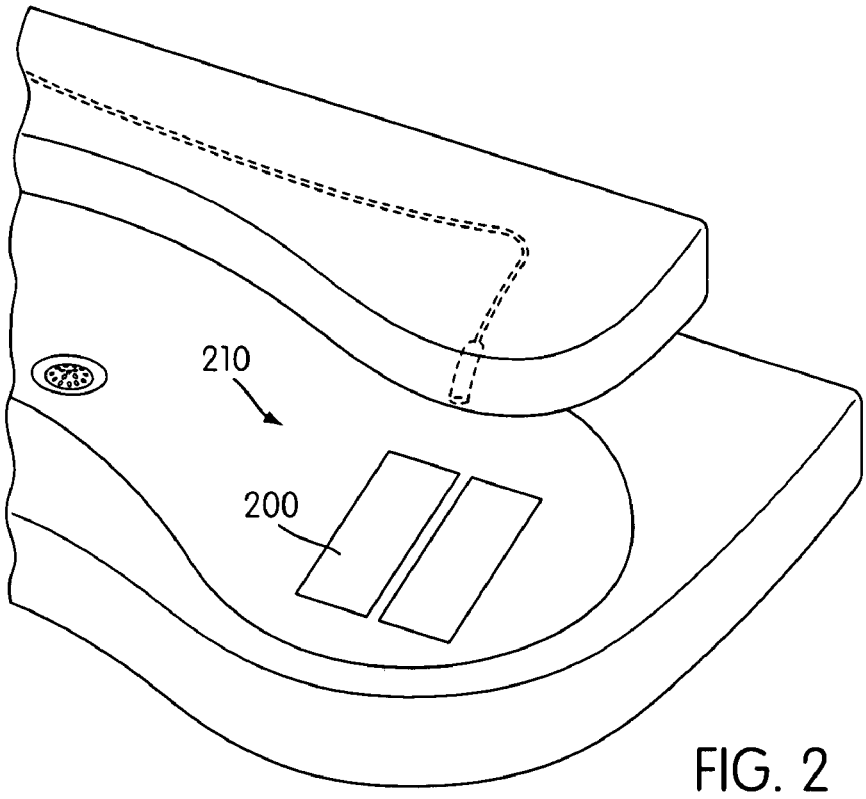
FIG. 2 is a perspective view of a side-by-side sensor plate configuration in the capacitive sensing system of FIG. 1 according to an exemplary embodiment.
Figure 3:
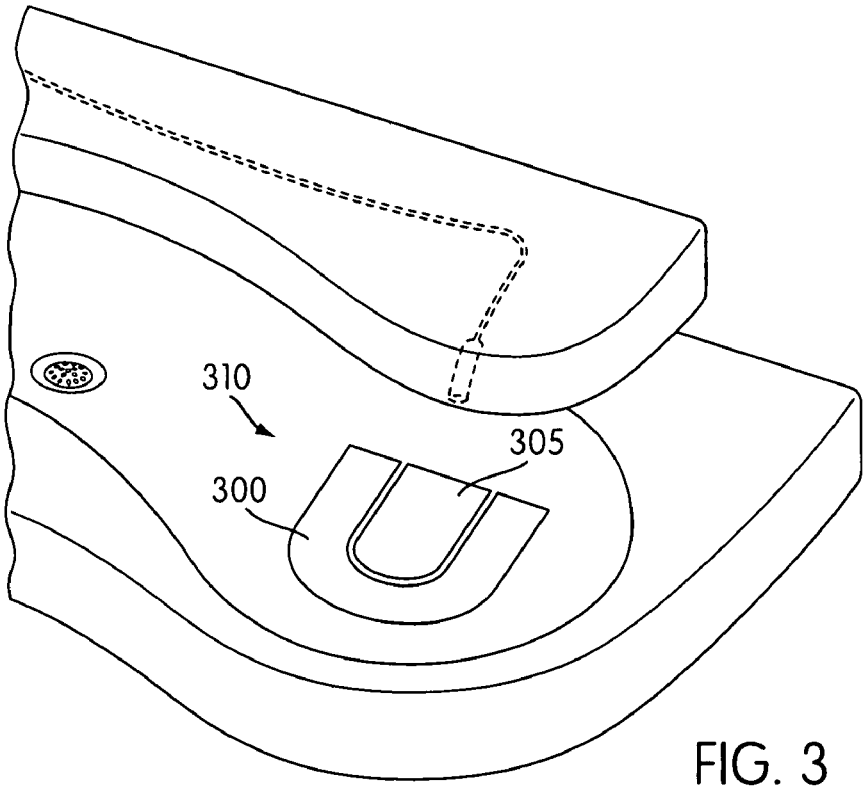
FIG. 3 is a perspective view of a U-shaped sensor plate configuration in the capacitive sensing system of FIG. 1 according to an exemplary embodiment.
Figure 4:
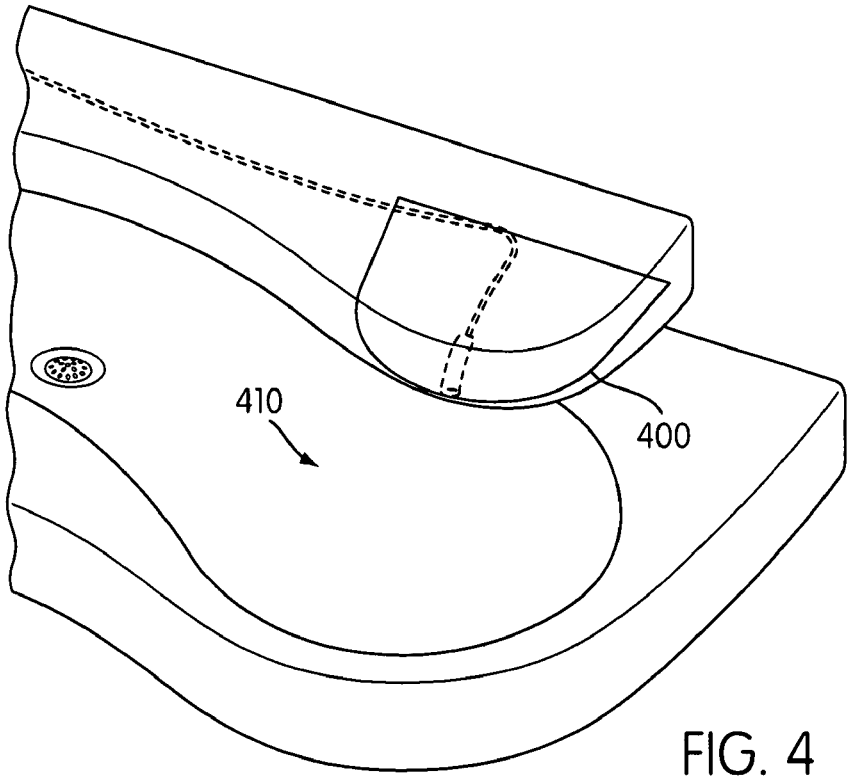
FIG. 4 is a perspective view of a single sheet metal sensor plate configuration in the capacitive sensing system of FIG. 1 according to an exemplary embodiment.
Figure 5:
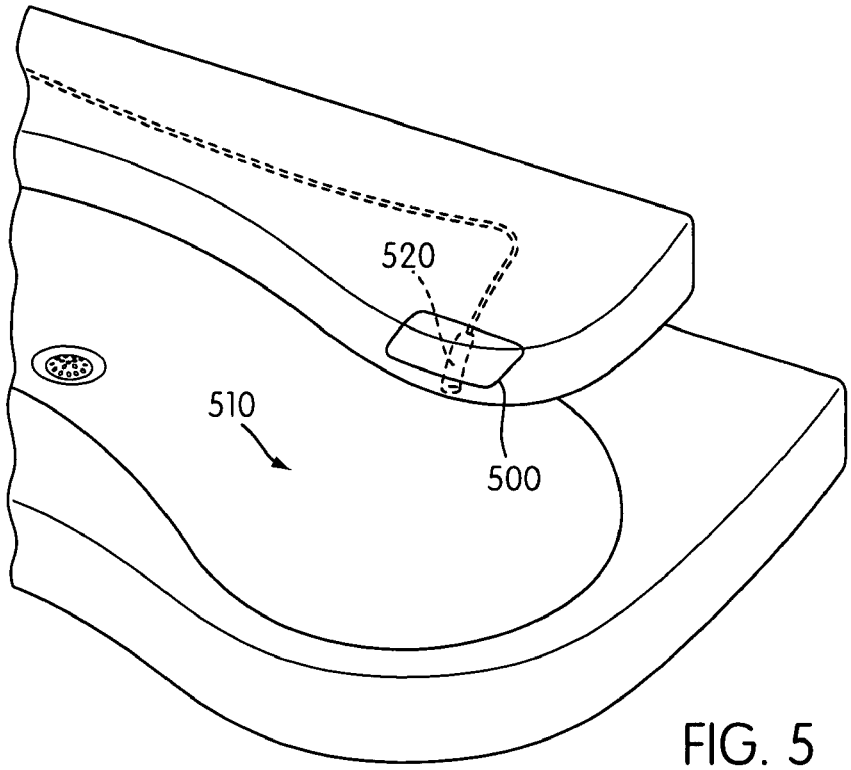
FIG. 5 is a perspective view of a single conductive coating sensor plate configuration in the capacitive sensing system of FIG. 1 according to an exemplary embodiment.
Figure 6:
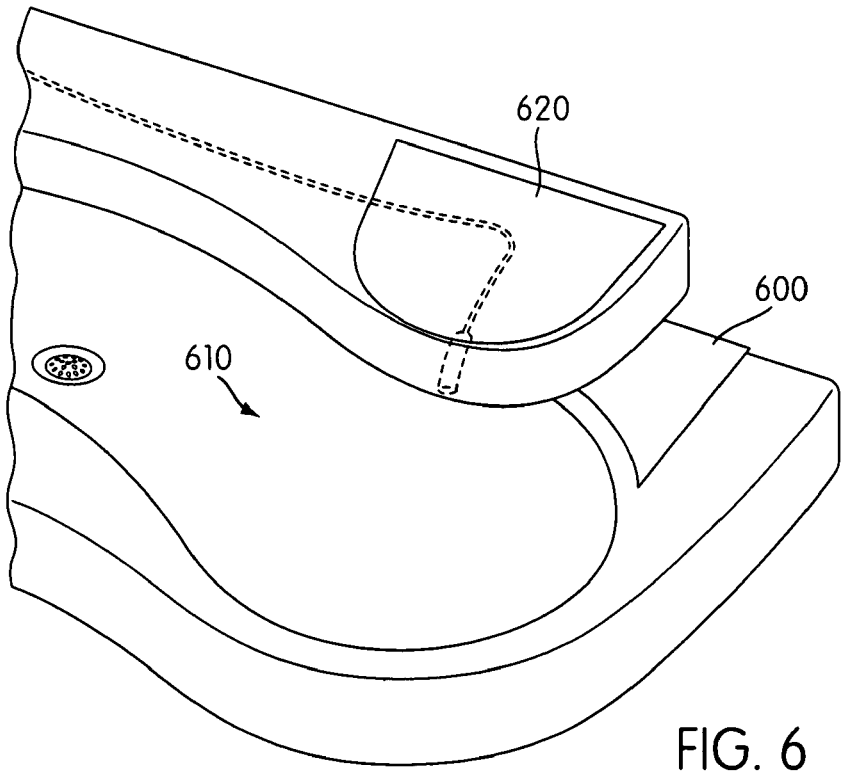
FIG. 6 is a perspective view of a sensor plate configuration with grounded guard plates in the capacitive sensing system of FIG. 1 according to an exemplary embodiment.
Figure 7:
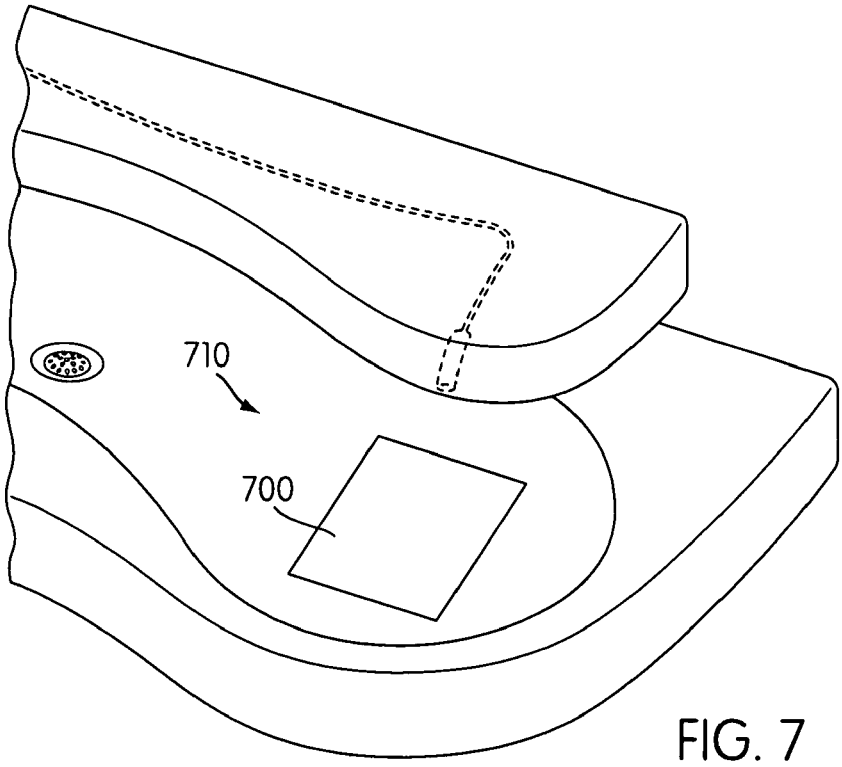
FIG. 7 is a perspective view of a single sensor plate configuration below the wash area in the capacitive sensing system of FIG. 1 according to an exemplary embodiment.

Sensor 140 (e.g. sense electrodes, antennas, etc.) may include one or more plate members that detect a change in capacitance within a sensed area (field, space, region, etc.). For example, FIGS. 4, 5, and 7 show a single plate member; FIGS. 2, 3, and 6 show two plate members; alternatively there may be three or more plate members. The plate members are configured so that a user's hand will provide a strong field when crossing the field generated by the plate member(s). Alternatively, the sensor is wire shaped or coiled to provide a desired field. According to a preferred embodiment, the sensor comprises two or more plate members. Using two or more plate members reduces or eliminates the effect of water passing through the sensed area (i.e., over or above the plate members). Each plate member measures the capacitance or charge relative to the other plates. Because the measurement is not absolute to ground, the relative measurement of the plate members zeros or eliminates the effect of the flowing water. For example, when a hand of a user enters the space above the plate members, there is an imbalance or change in the capacitance values being measured by the plate members. The system measures the capacitance between a first plate and its environment and measures the capacitance between a second plate and its environment. The processor then calculates the difference between the two measured capacitance values and calculates the change over time to determine whether to change the operational status of the fixture.

According to an alternative embodiment, each plate member measures the capacitance or charge relative to its environment (e.g., to a theoretical or actual ground). The measurement of each plate member to ground zeros or eliminates the effect of the flowing water. The processor then calculates the difference between the two measured capacitance values and determines whether to change the operational status of the fixture.

According to an exemplary embodiment shown in FIG. 2, the sensor includes two (side by side) plate members 200 below a wash area 210. Locating sensor plate members 200 below wash area 210 allows for the use of a large plate size maximized detection signal, does not require the use of a guard plate, is able to extend detection window farther from the water nozzle, offers less difference between wet and dry conditions, and simplifies installation. Plate members 200 are disposed near one another and the user is sensed by changes of capacitance in electric fields generated by the plate members due to dielectric or conductive effects.

According to a preferred embodiment shown in FIG. 3, the sensor includes first and second plate members 300 and 305 below the wash area 310 in a U-shaped configuration. Plate 300 and 305 members are configured so that a user's hand will provide a strong field on the outer plate when it is crossed and a strong field on the inner plate when it is crossed. Plate members 300 and 305 are shaped and configured to provide good detection from any approach by a user's hands entering the wash area, allow for use of a large plate size maximized detection signal, does not require the use of a guard plate, is able to extend detection window farther from the water nozzle, and offers less difference between wet and dry conditions.

According to alternative embodiments shown in FIGS. 4-6, the sensor includes a single plate member located above the wash area. Locating the plate member above the wash area is intended to minimize the effect of water. FIG. 4 shows a sensor plate configuration where a single metal plate 400 (e.g., sheet metal) is located above a wash area 410. FIG. 5 shows a sensor plate configuration where a single plate 500 is located above a wash area 510 using a conductive coating on a nozzle insert 520. FIG. 6 shows a sensor plate configuration where a single plate 600 above a wash area 610 along with a grounded plate 620 to shape the capacitive field.

According to an alternative embodiment shown in FIG. 7, the sensor includes a single plate member 700 below a wash area 710. Locating sensor plate member 700 below wash area 710 allows for the use of a large plate size that maximizes detection signal, does not require a guard plate, and is able to extend detection window farther from the water nozzle.

According to other alternative embodiments, the one or more plate members may be sized and orientated in a variety of configurations and arrangements.

Sensing control and detection circuit 150 is configured to control the sensing and detection operation and provide an output signal that ultimately actuates the fixture (e.g., turns a faucet on and off). Sensing control and detection circuit 150 may be configured to operate continuously or operated only as long as required for one or more measurements to be taken. According to a preferred embodiment, sensing control and detection circuit 150 operates sensor 140 as a proximity sensor by calculating the change in relative capacitance between the plates over time. According to an alternative embodiment, sensing control and detection circuit 150 operates sensor 140 as a proximity sensor by calculating the change in capacitance with respect to a reference level that does not vary or only slowly varies over a time period, rather than motion sensing that measures a rapid change in capacitance.

Figure 8:
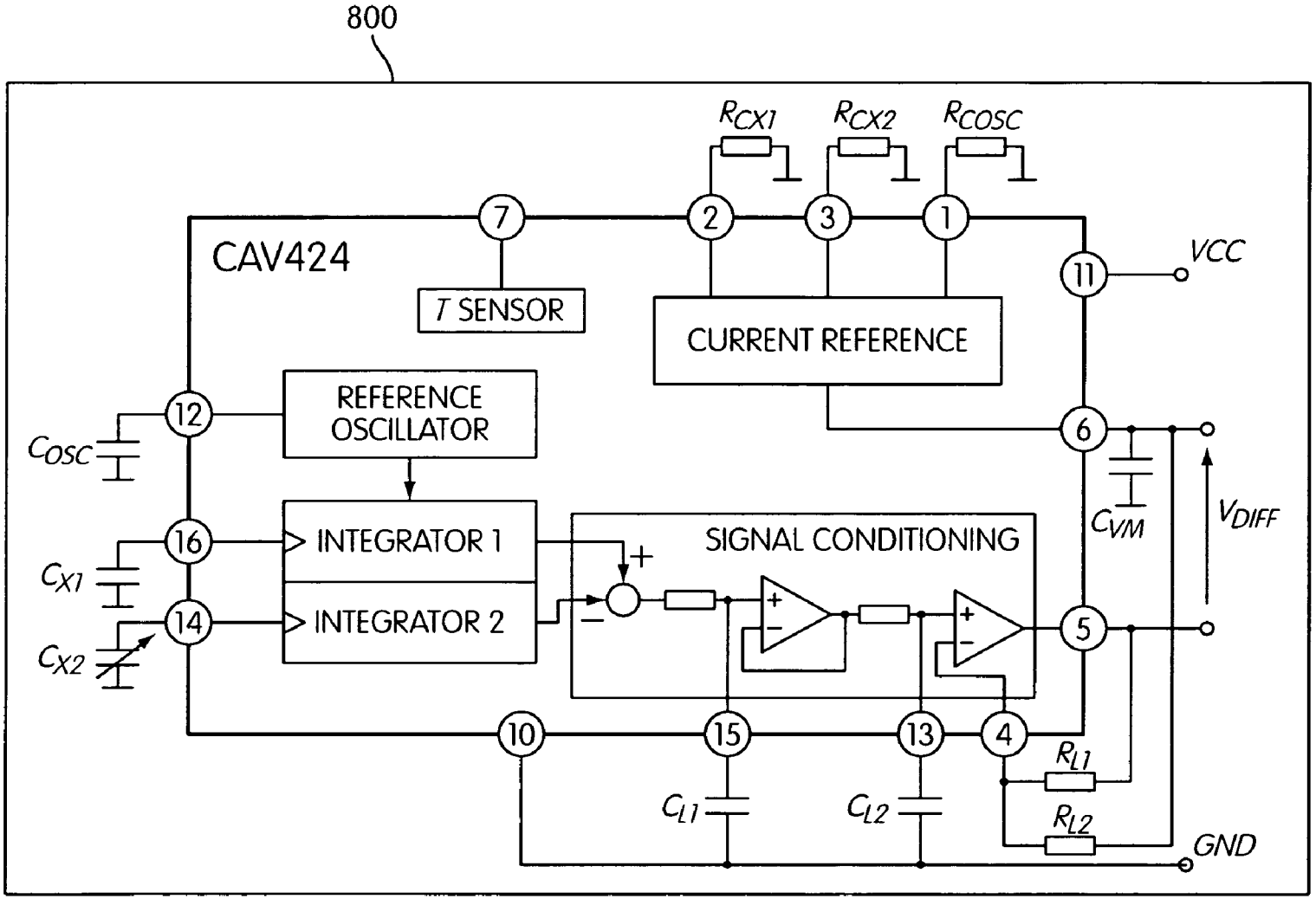
FIG. 8 is a sensing control and detection circuit of the capacitive sensing system of FIG. 1 according to an exemplary embodiment.
Figure 9:
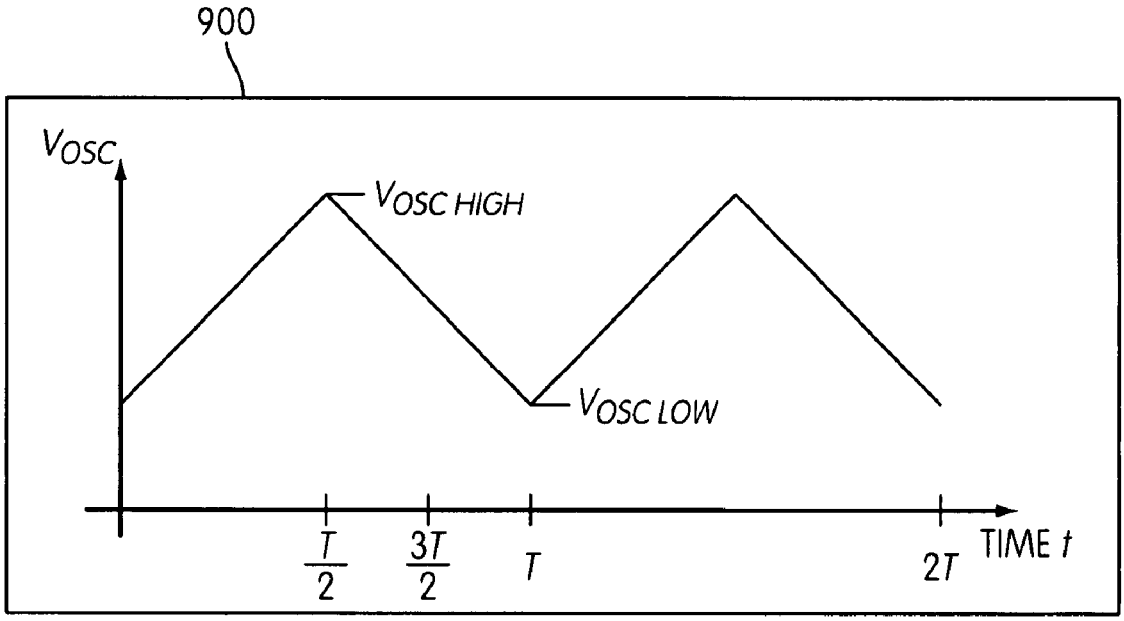
FIG. 9 illustrates an internal oscillator voltage curve for the circuit of FIG. 8, according to an exemplary embodiment.
Figure 10:
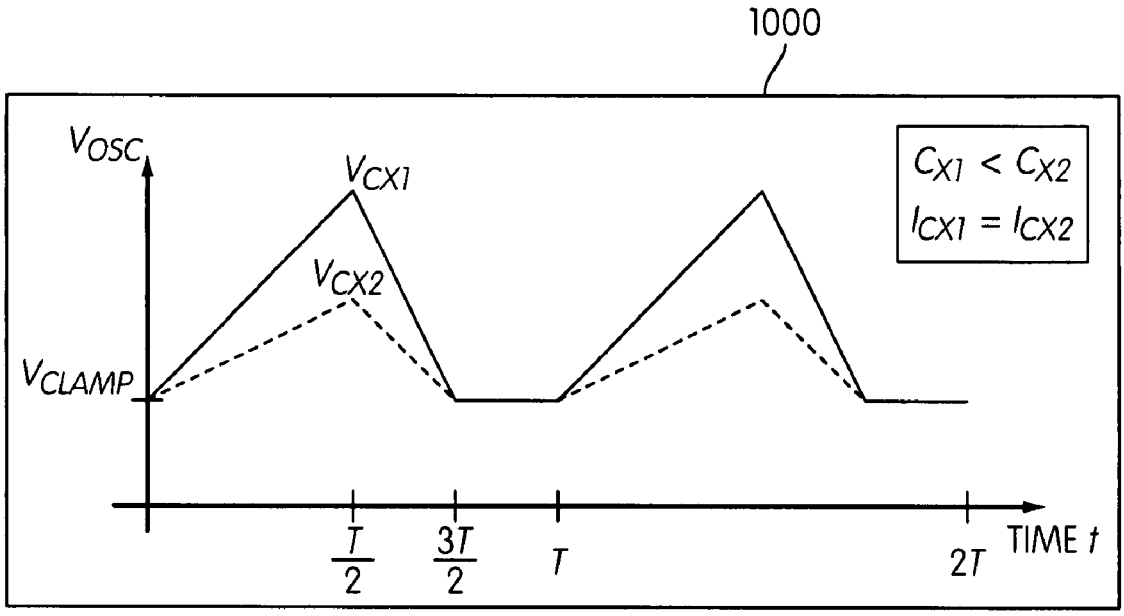
FIG. 10 illustrates an internal sensor curve before the output filter of the circuit of FIG. 8, according to an exemplary embodiment.

According to a particularly preferred embodiment shown in FIGS. 8-10, sensing control and detection circuit 150 is provided by a "CAV424" chip or circuit 800 commercially available from Analog Microelectronics, which has a detection frequency of up to about 2 kHz, an output op-amp available to maximize detection signal, and a DC level output. An exemplary operation of the CAV424 chip would provide for it to be on for approximately 3 ms. FIG. 9 illustrates an exemplary internal oscillator voltage curve 900 for the CAV424 chip. FIG. 10 illustrates an exemplary internal sensor curve 1000 before the output filter. According to alternative embodiments, the processing may be conducted by standard control logic, a field programmable gate array (FPGA), a programmable logic array (PLA), or the like.

In FIGS. 8-10, the symbols used in illustrating the CAV424 chip (FIG. 8) and the corresponding internal oscillator voltage curve (FIG. 9) and the internal sensor curve (FIG. 10) have the following meanings, as is well know to those in the art: "V" represents a voltage value; "R" represents a resistance value, "C" represents a capacitance value, "VCC" refers to a supply voltage, and "GND" represents ground. The following subscripts for "V," "C," and "R," are understood to have the following meaning: "OSC" denotes a value associated with an oscillator, "L" denotes a value associated with a low-pass filter, "X" denotes a value associated with an integrator, "M" denotes a reference value, and "DIFF" refers to a difference value. Where numerals appear within a subscript, it is further understood that the numerals are used to distinguish between different values of the same type. For example, the symbol "$C_{L1}$" refers to a first capacitance associated with a low-pass filter and "$C_{L2}$" refers to a second capacitance value associated with a low-pass filter.

The sensing control is derived by watching for acceleration of the differential capacitive signals (i.e., a change in the rate of change of the relative capacitance between the different plates). This is used to detect the differences between noise, user activity and water effects (e.g., splashing, draining, and standing water). For example the circuit may take samples measurements every quarter second, calculate the difference from the last recorded sample and then look for patterns in the rising and falling of a signal (for example, a rising signal by 3% followed by a falling signal of 2% within 3 samples) to indicate that a person has placed his or her hands into the field to activate the device.

According to an alternative embodiment, sensing control and detection circuit 150 is programmed to operate by continuously calculating an average of multiple capacitive measurements (i.e., progressive or rolling average value) measured at regular intervals. For example, the circuit may take sample measurements every quarter second and maintain the average over the past minute. Alternatively, any of a variety of sampling may be used. When a user places his or her hands in the capacitive field, the (instantaneous) detected value is compared to the average value. If the change or difference is greater than a predetermined level, then the faucet is triggered (turned on).

The power supply may be provided by any of a variety of power supplies 170. According to an exemplary embodiment, the power supply is a 24 VAC transformer 180. According to another exemplary embodiment, the power supply is a 6 VDC battery 190.

Figure 11:
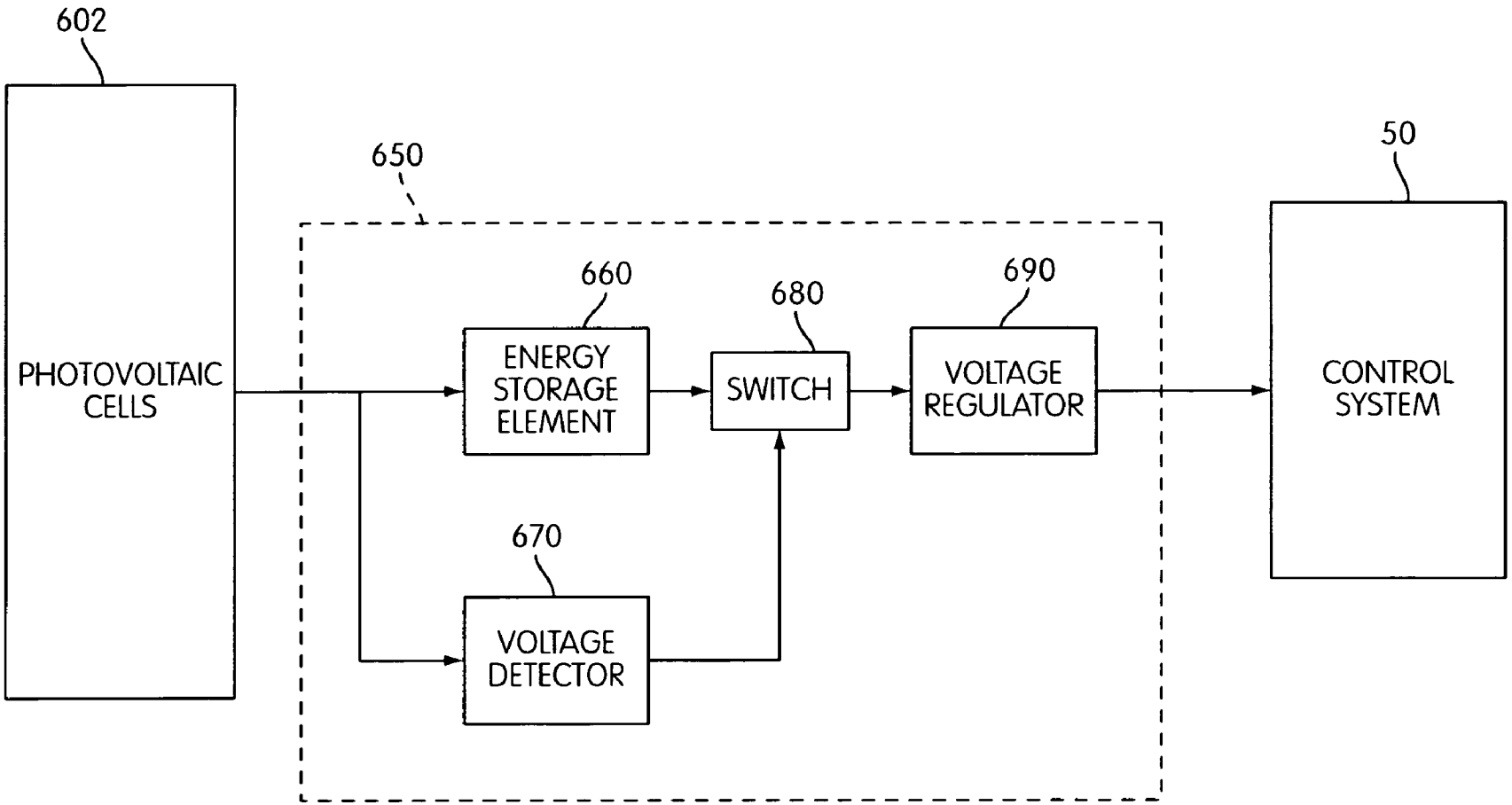
FIG. 11 is a block diagram of a power management system in the capacitive sensing system of FIG. 1 according to an exemplary embodiment.

According to another exemplary embodiment, the power supply is a "green" or more environmentally friendly photovoltaic cell system. FIG. 11 shows a block diagram of a power management system 650 and components thereof that advantageously provides for an efficient use of the electrical energy generated by a photovoltaic cell system, shown as photovoltaic cells 602. Power management system 650 is shown as generally including an energy storage element 660 configured to receive and store electrical energy generated by photovoltaic cells 602, a detector 670 configured to measure the level (intensity) of ambient light, a switch 680 configured to disconnect energy storage element 660 from control system 50 if the level of ambient light drops below a predetermined value, and a voltage regulator 690 for adjusting the voltage being outputted to control system 50.

According to an exemplary embodiment, energy storage element 660 includes one or more capacitors suitable for receiving a electric charge from photovoltaic cells 602 and supplying an output voltage to a control system 50 utilizing a capacitive sensing system. According to a preferred embodiment, energy storage element 660 includes a plurality of capacitors arranged in series to provide a desired capacitance. Any number and/or type of capacitors may be used and such capacitors may be arranged in series and/or in parallel.

Energy storage element 660 may be fully charged or partially charged by photovoltaic cells 602. The rate at which energy storage element 660 is charged depends at least partially on the intensity of the ambient light and the effectiveness (e.g., number, size, efficiency, etc.) of photovoltaic cells 602. During an initial setup (e.g., anytime energy storage element 660 is fully discharged), the time required to charge energy storage element 660 to a level sufficient to operate the components of control system 50 may be relatively long. The charging time during the initial setup can be reduced by adding a supplemental power source (e.g., a battery, etc.) to charge energy storage element 660. The supplemental power source provides a "jump-start" for energy storage element 660, and may significantly reduce the charging time. Preferably, any supplemental power source is removed once energy storage element 660 is sufficiently charged, but alternatively, may remain coupled to the system but electrically disconnected from energy storage element 660.

A fully charged energy storage element 660 is capable of providing a sufficient amount of electrical energy to power control system 50 for the selective operation of one or more hands-free fixtures. According to an exemplary embodiment, energy storage element 660 is capable of providing a sufficient amount electrical energy to allow for more than one activation of the fixtures before energy storage element 660 needs to be recharged. In a typical application (e.g., an application wherein photovoltaic cells 602 are exposed to ambient light while lavatory system 10 is being used), photovoltaic cells 602 will continue to charge energy storage element 660 as electrical energy is provided for the activation of the fixtures.

Control system 50 constitutes a load on energy storage element 660 that when electrically coupled thereto diminishes the electrical energy stored in energy storage element 660. Disconnecting energy storage element 660 from such a load will help maintain the charge of energy storage element 660. To determine whether power should be conserved by disconnecting control system 50 from energy storage element 660, power management system 650 further includes voltage detector 670. Voltage detector 670 includes an input 672 electrically coupled to an output from photovoltaic cells 602. Voltage detector 670 also includes an output 674 electrically coupled to switch 680.

An output voltage is provided by photovoltaic cells 602. The magnitude of the output voltage may be based upon the intensity of the ambient light and the efficiency of photovoltaic cells 602. Voltage detector 670 detects whether photovoltaic cells 602 are being exposed to a level of ambient light sufficient to meet the power demands of control system 50. According to an exemplary embodiment, a reference voltage value (a baseline value) representative of the sufficient level of ambient light is maintained by voltage detector 670. Such a reference value may be changed depending on the power requirements of control system 50.

According to an exemplary embodiment, if photovoltaic cells 602 are not being exposed to a sufficient level of ambient light, the assumption is that lavatory system 10 is not in use (e.g., the lights have been turned down and/or off) and that control system 50 does not need to be powered. In such a situation, control system 50 may be disconnected from power management system 650 in an effort to conserve electrical energy. Alternatively, the control system may require a delay prior to turning on or off, may not turn off, or the like. According to a preferred embodiment, voltage detector 670 measures the output voltage of photovoltaic cells 602 (received at input 672) and compares the output voltage with the reference voltage value. If the output voltage level is below the reference voltage level, voltage detector 670 will send an output signal (at output 674) to switch 680 indicating that control system 50 should be electrically disconnected from power management system 650. According to various alternative embodiments, voltage detector 670 may be replaced with any detector suitable for detecting the intensity of the ambient light at photovoltaic cells 602 including, but not limited to, a photodetector configured to monitor the ambient light and send a corresponding signal to switch 680. According to an alternative embodiment, control system 50 compares incoming power to outgoing power to determine if sufficient power is available to maintain the operation of control system 50. If there is not sufficient power, control system 50 is disconnected from the power management system 650.

Preferably, energy storage element 660 is capable of holding a charge with minimal leakage when disconnected from the load (control system 50). Providing energy storage element 660 that is capable of maintaining a charge with minimal leakage, may allow energy storage element 660 to meet the electrical power requirements of control system 50 after photovoltaic cells 602 have not been exposed to ambient light for an extended period of time (e.g., a weekend, etc.). This will eliminate the need to recharge energy storage element 660 (e.g., by a supplemental power source and/or by photovoltaic cells 602, etc.), or at least reduce the time required to recharge energy storage element 602, when the ambient light returns and a user seeks to use fixtures 14 of lavatory system 10. When voltage detector 670 measures a voltage at or above the predetermined baseline voltage, switch 680 reconnects power management system 650 to control system 50.

Power management system 650 is further shown as including voltage regulator 690 adapted for receiving a first voltage from photovoltaic cells 602 and providing a second voltage to control system 50. According to an exemplary embodiment, voltage regulator 690 is capable of providing a relatively stable operating voltage to control system 50. According to an exemplary embodiment, voltage regulator 690 is shown schematically as a dc-to-dc converter. As can be appreciated, the input and output voltages may vary in alternative embodiments.

As for the activation of the one or more valves controlling the output from the fixtures, any suitable valve control system may be provided. According to an exemplary embodiment, one or more solenoid valves are provided for controlling the output from the fixtures. These solenoid valves are configured to receive a signal representative of whether the valves should be in an open or closed position. Such a valve configuration may be substantially the same as the one disclosed in U.S. patent application Ser. No. 11/041,882, filed Jan. 21, 2005 and entitled "Lavatory System," the complete disclosure of which is hereby incorporated by reference in its entirety.

Processor 160 is configured to operate the entire system. According to exemplary embodiments, processor 160 may be any of a variety of circuits configured to control the operation (e.g., CPU, standard control logic, field programmable gate array (FPGA), etc.). According to a particularly preferred embodiment, processor 160 is commercially available as PIC16F886 from Microchip. According to an alternative embodiment, processor 160 is commercially available as PIC16LF876 from Microchip. Alternatively, any of a variety of processors may be used.

Figure 12:
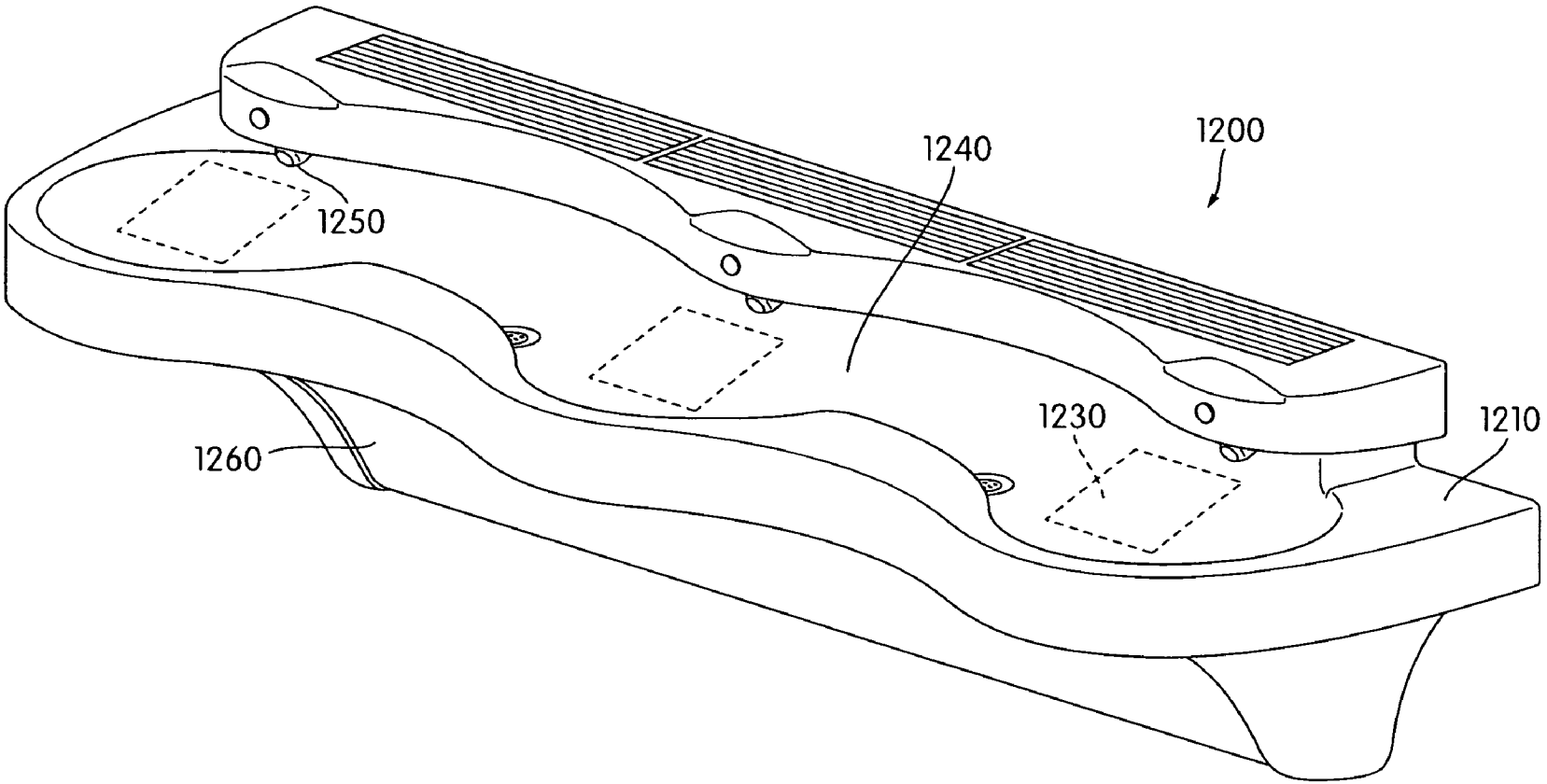
FIG. 12 is a perspective view of a hand-washing lavatory system that includes the capacitive sensing system of FIG. 1 according to an exemplary embodiment.

FIG. 12 shows an exemplary lavatory system 1200 configured to accommodate multiple users with independent handwashing stations for users to attend to their washing needs. Lavatory system 1200 includes a deck 1210 (e.g., lavatory deck, countertop, etc.), a drain system disposed below the deck, a cover configured to enclose plumbing system, and a capacitive sensing system 1230 (with the capacitive sensing plates/electrodes/antennas shown schematically in broken lines) mounted below the receptacles. The broken lines identifying the sensing system 1230 plates schematically illustrate that one, two, three, or more plates may be used for the sensing system. Lavatory system 1200 may be configured for attachment to a surface such as a wall of a restroom or other area where it may be desirable to provide a lavatory services, or configured as a free-standing structure. An adjacent wall may be provided with the plumbing source (including both (or either) a hot and cold water supply, preferably combined with a thermostatic mixing valve, or a tempered water supply, a drain, etc.) and an optional source such as an electrical outlet (preferably providing 110 volts GFCI).

The hand washing stations generally each include a receptacle 1240 (e.g., bowl, sink, basin, etc.) and a spray head 1250 (e.g., faucet assembly). Receptacle 1240 may be a separate component coupled to countertop 1210 or integrally formed (e.g., cast, molded, etc.). A front apron 1260 extends down from the countertop and is configured to provide a frontal surface to conceal certain components of the lavatory system and may have any number of a variety of contours or shapes. A backsplash extends up from the countertop and is configured to protect the wall adjacent to countertop 1210 (e.g., from water splashed from the lower and upper stations or other physical damage).

Deck 1210 may be made from any of a variety of materials, including solid surface materials, stainless steel, laminates, fiberglass, and the like. When a metallic or conductive material is used, the deck needs to be insulated from the sensor(s). According to a particular preferred embodiment, the deck is made from a densified solid surface material that complies with ANSI Z124.3 and Z124.6. According to a particularly preferred embodiment, the surface material is of a type commercially available under the trade name TERREON® from Bradley Corporation of Menomonee Falls, Wis.

Figure 13:
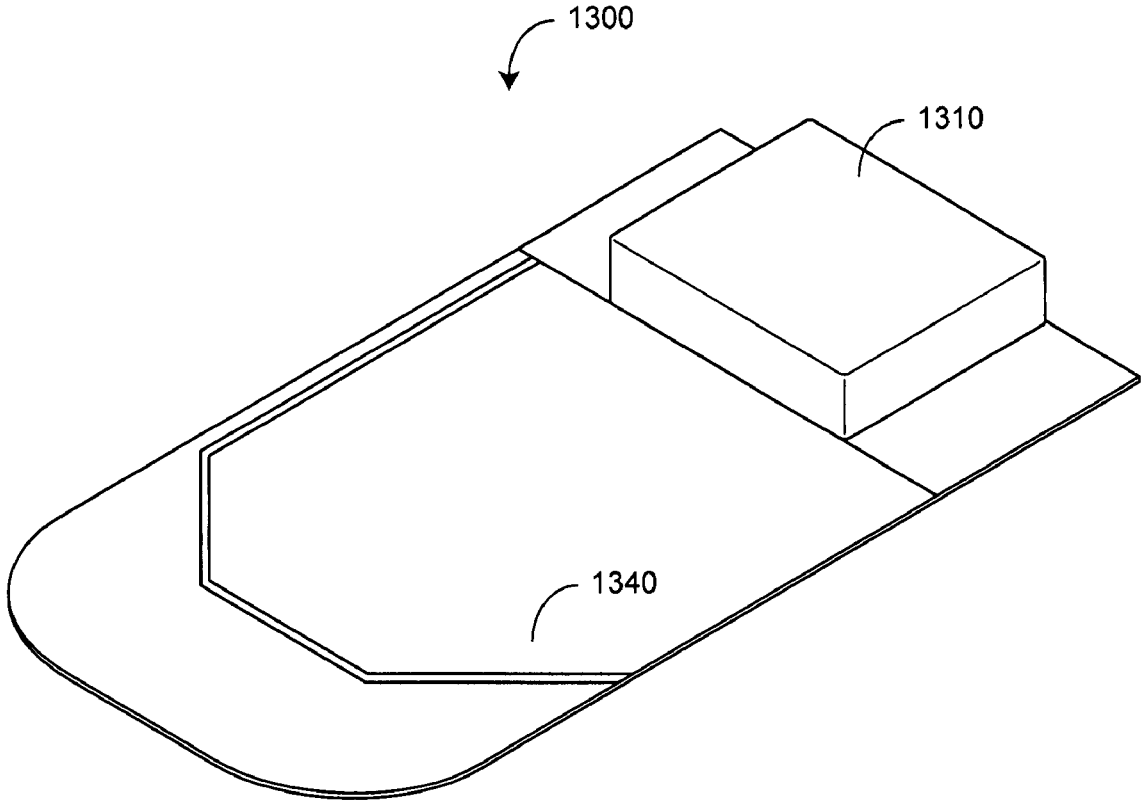
FIG. 13 is a perspective view of the sensor plates, electronics module, and circuit board of the capacitive sensing system of FIG. 1 according to an exemplary embodiment.

According to an exemplary embodiment shown in FIG. 13, a sensor 1340 and a circuit 1310 are integrally provided on a common integrated circuit board 1300. Circuit 1300 may include sensing control and detection circuit(s) 150, power management and valve actuation circuit(s) 130, and processor 160. Sensor(s) 1340 and/or integrated circuit board 1300 is preferably located at or below the receptacle/bowl of the lavatory (e.g., rather than in the faucet, header, spray head, etc.). Alternatively, sensor(s) 1340 and/or integrated circuit board 1300 is located at a variety of locations below the sink line. Sensor(s) 1340 and/or integrated circuit board 1300 is preferably coupled to a bottom surface of lavatory deck 1210 or bowl 1240 (e.g., mounted on stand offs or bosses with fasteners or clips). Alternatively, bowl 1240 or lavatory deck 1210 is molded or cast around sensor(s) 1340 and/or integrated circuit board 1300 (i.e., encapsulated). Alternatively, the plate members may be wires or strips of conductive material (e.g., copper) molded into the bowl or lavatory deck rather than on the circuit board.

Figure 14:
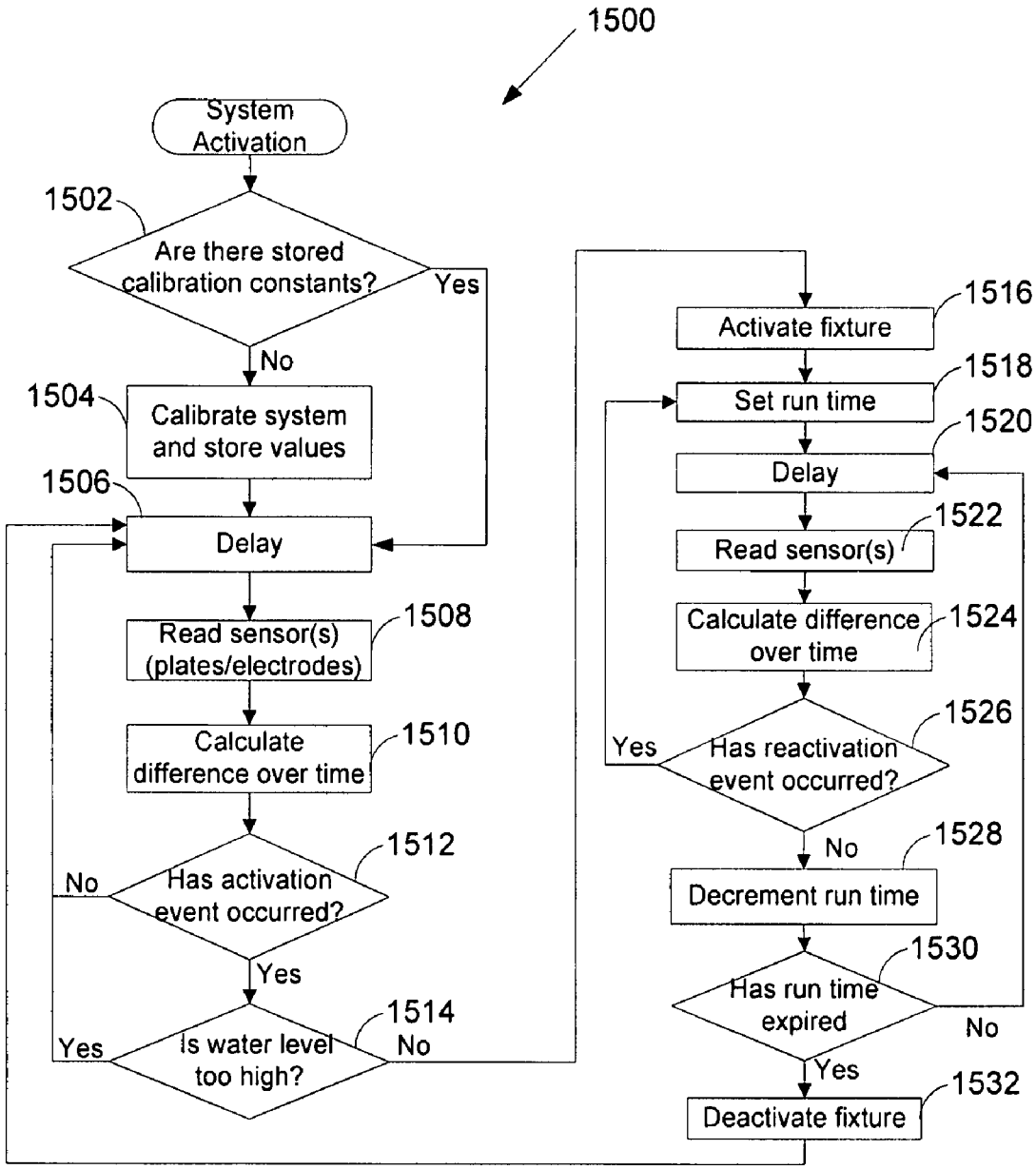
FIG. 14 is a process flow diagram illustrating a process for capacitive sensing in the capacitive sensing system of FIG. 1 according to an exemplary embodiment.

FIG. 14 shows an exemplary process 1500 for capacitive sensing of the lavatory system/fixture. After activation, at a step 1502, the system checks for any stored calibration constants (e.g., magnetic field values, sensor configuration information, etc.). The calibration steps are preferably include calibration when the lavatory is dry (e.g., no water in the sinks/bowls) and when wet (e.g., water in and/or flowing through the sink area). If no calibration constants exist, then the system calibrates and stores values at a step 1504 followed by a delay period at a step 1506. If any calibration constants do exist, then the system has been calibrated and may proceed to delay period 1506. The delay step or period is configured to minimize power consumption and allow the lavatory system to operate and/or react to inputs/outputs. Generally, after the system has been calibrated, process 1500 works in a non-activated loop (left side below calibration steps, fixture is waiting to be used) or an activated loop (right side, fixture has been activated for a hand washing operation).

At a step 1508 in the non-activated loop, the system reads one or more sensor electrodes and/or plates. At a step 1510, the system calculates any difference in the sensor values obtained in step 1508 over a predetermined time period (e.g., 1 second, 0.5 seconds, 100 milliseconds, etc.). For example, if a user has placed his or her hands near the sensor, the system may sense different sensor values than w hen the hands were not present. According to an exemplary embodiment, the system counts the number of cycles that one or more oscillators oscillates over the predetermined time period and compares the counted cycles to a value (e.g., the previous cycle count) to determine whether the environment in the hand washing area is changing (e.g., in the bowl/sink and its surrounding area, etc.). For example, the system may use an oscillator that oscillates at 40 kHz to avoid other electrical/electronic "noise" in the room (e.g., produced by fluorescent lighting). A hand moving near the plates will cause the oscillation frequency of the oscillator to decrease (e.g., from 40 kHz to 37 kHz) because the oscillation frequency is determined by the resistance and capacitance, which are affected by the hand moving near the plates. The system may provide one oscillator per sensing plate. To inhibit or prevent an activation due to the presence of water in the sink, the system uses two or more sensing plates (e.g., 2, 3, 4, etc.). Although water will affect the sensed capacitive value, the effect on the two or more oscillators will be approximately the same as the water spreads across the bottom of the sink whereas a hand passing into the hand washing area will have a different effect on the sensed capacitive values (i.e., will change the frequency of the oscillators differently). The oscillators functionality may be provided by comparator(s) integrated in the CPU or by op-amps (i.e., oscillator frequency is changed by the environment). According to a preferred embodiment, the oscillator is provided as an RC oscillator (i.e., tuned circuit built using resistors and capacitors). Alternatively, the capacitive sensing function may be provided by the commercially available CAV424 as discussed above (which has a reference oscillator at a single frequency and integrates the signals received).

At a step 1512, if an activation event has not occurred, the system returns to delay period 1506, for example to read the sensors again. If an activation event has occurred, the system continues to a step 1514 to check if the water level of the system is beyond a threshold value or is too high. The water level height query, for example, determines whether there may be a blocked drain. If the water level is too high, the system returns to delay period 1506 and may be configured to initiate an alarm. If the water level is below the threshold, the system moves to a step 1516 in the activated loop.

At step 1516, the fixture (e.g., faucet, spray head, etc.) is activated. At a step 1518, a run time that the fixture should be active for is set. At a step 1520, a delay period is configured to minimize power consumption and allow the lavatory system to operate and/or react to inputs/outputs. At a step 1522, the system reads one or more sensor electrodes and/or plates. At a step 1524, the system calculates any difference in the sensor values obtained in step 1522 over a predetermined time period (e.g., ranging from 2 seconds to 50 milliseconds, such as 2 seconds, 1 second, 0.5 seconds, 100 milliseconds, 50 milliseconds, etc.). For example, if a user's hands remain in an area near the sensor, the system may sense little to no difference in sensor values than when the system was inactive. At a step 1526, if a reactivation activation event has occurred (e.g., a user's hand remain near the sensor), the system returns to step 1518 to reset the run time. If an activation event has not occurred, the system continues to a step 1528 to decrement the run time by a predetermined value. At a step 1530, if the time period has not expired, the system returns to delay period 1520 for further sensing and decrementing until the run time has expired. If the time period has expired, the system deactivates the fixture at a step 1532 and returns to delay period 1506 to check for further activation of the system. According to other alternative embodiments, the process may comprise a variety of other steps and sequences.

It is also important to note that the construction and arrangement of the elements of the capacitive system as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the embodiments. For example, for purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components. Accordingly, all such modifications are intended to be included within the scope of the present invention as defined in the disclosed embodiments. The order or sequence of any process or method steps may be varied or re-sequenced according to alternative embodiments. In the embodiments, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the embodiments described.

What is claimed is:

1. A hand washing lavatory system comprising:

a receptacle defining a hand washing area;

a fixture configured to deliver water to the hand washing area;

a first sense electrode coupled to the receptacle and configured to measure a first capacitive value;

a second sense electrode coupled to the receptacle spaced apart from the first sense electrode and configured to measure a second capacitive value; and a circuit configured to control operation of the fixture in response to a change in the first capacitive value relative to the second capacitive value, wherein the circuit is configured to eliminate the effects of water flowing from the fixture in controlling the operation of the fixture;

wherein the first sense electrode is U-shaped and the second sense electrode is located at least partially within the U-shape.

2. The hand-washing lavatory system of claim 1 wherein the circuit comprises a sensing control and detection circuit configured to control the sensing and detection operation and provide an output signal that actuates the fixture.

3. The hand-washing lavatory system of claim 2 further comprising a power management and valve actuation circuit configured to manage the power supply and to actuate a valve between an open position and a closed position.

4. The hand-washing lavatory system of claim 3 further comprising photovoltaic cells configured to provide at least a portion of the power used to operate the circuits and valve.

5. The hand-washing lavatory system of claim 1 wherein the first sense electrode is located below the hand washing area.

6. The hand-washing lavatory system of claim 5 wherein the second sense electrode is located below the hand washing area.

7. The hand-washing lavatory system of claim 1 wherein the first sense electrode and the second sense electrode are both located above the hand washing area.

8. The hand-washing lavatory system of claim 1 wherein the first sense electrode and the second sense electrode are integrated with the fixture, a drain, or combinations thereof.

9. The hand-washing lavatory system of claim 1 wherein the first sense electrode and the second sense electrode are at least partially encapsulated with the receptacle.

10. The hand-washing lavatory system of claim 1 wherein the fixture is a sprayhead.

11. The hand-washing lavatory system of claim 1 wherein the fixture is a faucet assembly.

12. The hand-washing lavatory system of claim 1, wherein the first sense electrode measures the first capacitive value relative to the second sense electrode and not absolute to ground.

13. The hand-washing lavatory system of claim 1, wherein the circuit is further configured to control operation of the fixture based on the change in the first capacitive value relative to the second capacitive value over time.

14. A hand-washing lavatory system comprising:

a deck having one or more receptacles providing one or more hand washing stations, and a sink line defining the top of the one or more receptacles;

at least one fixture located at least partially above the sink line and configured to deliver water to one or more of the hand washing areas;

a first sense electrode integrated with the deck and located below the sink line, the first electrode configured to measure a first capacitive value in the one or more hand washing area;

a second sense electrode integrated with the deck and located adjacent to the first sense electrode and below the sink line, the second sense electrode configured to measure a second capacitive value in the one or more hand washing area;

a valve movable between an open position wherein water is permitted to flow through the fixture and a closed position wherein water is prevented from flowing through the fixture;

a circuit coupled to the first sense electrode, the second sense electrode, and the valve, and configured to move the valve between the open position and the closed position in response to a change in the first capacitive value relative to the second capacitive value, the circuit being further configured to eliminate the effect of the presence of water proximate the first and second sense electrodes in controlling the valve wherein the first sense electrode is U-shaped and the second sense electrode is located at least partially within the U-shape.

15. The hand-washing lavatory system of claim 14 wherein the receptacle is made from a non-conductive material.

16. The hand-washing lavatory system of claim 15 wherein the first sense electrode at least partially surrounds the second sense electrode.

17. The hand-washing lavatory system of claim 16 wherein the first sense electrode and the second sense electrode are integrally formed as part of a circuit board containing the circuit.

18. The hand-washing lavatory system of claim 17 wherein the first sense electrode is a first conductive area on the circuit board and the second sense electrode is a second conductive area on the circuit board spaced apart from the conductive area of the first sense electrode.

* * * * *

UNITED STATES PATENT AND TRADEMARK OFFICE

CERTIFICATE OF CORRECTION

PATENT NO. : 8,381,329 B2
APPLICATION NO. : 11/877469
DATED : February 26, 2013
INVENTOR(S) : Bayley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1403 days.

Signed and Sealed this
Eighteenth Day of November, 2014

Michelle K. Lee

Michelle K. Lee
*Deputy Director of the United States Patent and Trademark Office*